US005199617A

United States Patent [19]

Bennett

[11] Patent Number: 5,199,617

[45] Date of Patent: Apr. 6, 1993

[54] CAP FOR CONTAINERS

[76] Inventor: Robert A. Bennett, 170 Sturbridge Rd., Easton, Conn. 06612

[21] Appl. No.: 872,337

[22] Filed: Apr. 23, 1992

[51] Int. Cl.[5] ..... B65D 25/40

[52] U.S. Cl. ..... 222/498; 222/505; 222/507; 222/548

[58] Field of Search ..... 222/212, 476, 498, 505, 222/506, 507, 548

[56] References Cited

U.S. PATENT DOCUMENTS

| | | | |
|---|---|---|---|
| 3,337,098 | 8/1967 | Johns | 222/505 |
| 3,446,406 | 5/1969 | Trott | 222/507 |
| 4,832,235 | 5/1989 | Palmer | 222/548 X |

*Primary Examiner*—Andres Kashnikow
*Assistant Examiner*—Joseph A. Kaufman

[57] ABSTRACT

A first vertical hollow cylinder is secured at an open lower end to the open end of the container. The first cylinder having a closed upper end with a small centrally disposed first opening therein and has a raised peripheral first lip. A curved vertical wall is secured to and extends upwardly from this upper end of the first cylinder. The wall engaging the first lip at two spaced apart positions and curves around one side of the first opening. A second vertical hollow cylinder open at both ends and secured to the upper end of the first cylinder so that its axial bore is vertically aligned with the first opening. A horizontally elongated member defines a figure 8 with left hand and right hand like half sections, each half section having a hole therein. One hole is sealed, the other hole being open. The member rests slidably on top of the second cylinder, with one member side slidably engaging the wall. A third vertical hollow cylinder has a second central opening aligned with the bore of the second cylinder and rotatably engages the first lip. First and second spaced vertical prongs extend downwardly from the third cylinder surface. Rotation of the third cylinder in one direction with respect to the first cylinder causing the first prong to engage the member, the member moving into a first position at which the sealed hole seals off the top end of the second cylinder. The third cylinder when rotated in the opposite direction causes the second prong to engage the member, the member moving into a second position at which the open hole is aligned with the open bore.

5 Claims, 1 Drawing Sheet

CAP FOR CONTAINERS

BACKGROUND OF THE INVENTION

The present invention is directed toward a cap for a container of material such as a liquid which can be secured to the container in sealed leak proof position. The cap can be rotated in one direction to produce an opening through which the material can be removed and can be rotated in opposite direction to close the opening and seal off the contents of the container. The cap can remain in place during the entire period of use of the container or can be removed and replaced as desired.

SUMMARY OF THE INVENTION

In accordance with the principles of the invention, the cap is adapted to be removably secured to an open end of a container. The cap employs a first vertical hollow cylinder having an open lower end adapted to be secured to the open end of the container. The first cylinder has a closed upper end with a small centrally disposed first opening therein and has a raised peripheral first lip.

A curved vertical wall is secured to and extends upwardly from the upper end of the first cylinder. The wall engages the first lip at two spaced apart positions, said positions and the first opening being disposed essentially along a common horizontal line. The wall is spaced from the first opening and curves around one side of the first opening, the top of the wall being horizontally aligned with the top of the first lip.

A second vertical hollow cylinder open at both ends is secured to the upper end of the first cylinder with an upper end horizontally aligned with the top of the wall. The second cylinder has an axial bore vertically aligned with the first opening, the wall being spaced from and extending around one side of the second cylinder.

A horizontally elongated member which in the horizontal plane has the shape of a figure 8 with left hand and right hand like half sections, has a top flat end having a surface with first and second spaced holes therein. Each hole has the same shape and size as the first opening and is disposed in a corresponding one of the half sections, one of said holes being sealed, the other hole being open. The member has an open bottom end which is circomferentially surrounded by a downwardly extending peripheral second lip. The member rests slidably on top of the second cylinder, one side of said member slidably engaging said wall.

A third vertical hollow cylinder having a flat top surface with a second central opening aligned with the bore of the second cylinder has an open bottom end. The third cylinder rotatably engaging the first lip and the surface of the member. The third cylinder has first and second spaced vertical prongs extending downwardly from its top surface.

When the third cylinder is rotated in one direction with respect to the first cylinder the first prong engages the member and causes it to move into a first position at which the sealed hole engages the top end of the second cylinder and seals off the bore, thereby sealing off the contents of the container.

When the third cylinder is rotated in the opposite direction, the second prong engages the member and causes it to move into a second position at which the open hole engages the top end of the second cylinder and is aligned with the open bore, thereby allowing the contents of the container to be discharged.

The member can be flexible and can have two elongated slots, each slot being disposed adjacent the periphery of a corresponding one of the sides of the member. Each slot extends from one half section to the other and conforms in shape to the corresponding adjacent portion of the periphery. When this member structure is used and a prong is caused to engage the member, the member is first deformed because the adjacent slot is deformed and then, as the slot is reformed, a snap action is produced forcing the member into the desired position.

DETAILED DESCRIPTION OF PREFERRED EMBODIMENT

Figure 1:
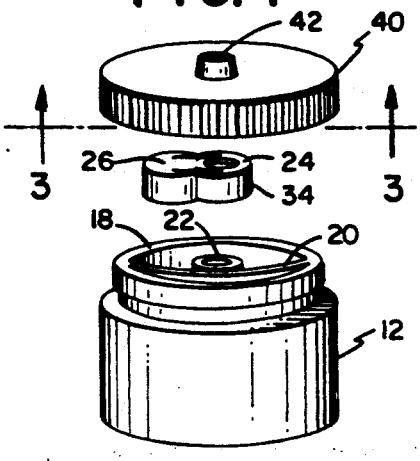
FIG. 1 is an exploded view of one embodiment of the invention.
Figure 2:
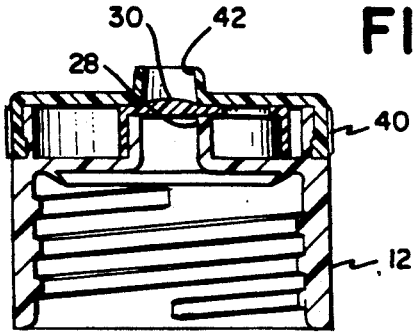
FIG. 2 is a cross sectional view showing structure of FIG. 1 in use.
Figure 3:
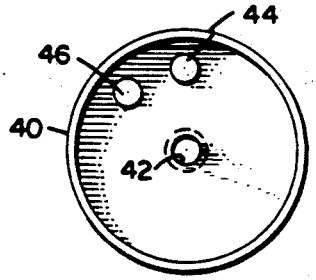
FIG. 3 is a view taken along line 3—3 in FIG. 1.

Referring first to FIGS. 1–4, the embodiment shown uses only plastic parts or components. A first vertical hollow cylinder 12 has an open lower end having an internal thread which can detachably engage the external thread of the open neck of a container 10. The first cylinder has a closed upper end 14 with a small centrally disposed first opening 16 therein and has a raised peripheral first lip 18.

A curved vertical wall 20 is secured to and extends upwardly from the upper end of the first cylinder. The wall engages the first lip 18 at two spaced apart positions, said positions and the first opening being disposed essentially along a common horizontal line. The wall is spaced from the first opening and curves around one side of the first opening, the top of the wall being horizontally aligned with the top of the first lip.

A second vertical hollow cylinder 22 open at both ends is secured to the upper end of the first cylinder with an upper end horizontally aligned with the top of the wall. The second cylinder has an axial bore vertically aligned with the first opening, the wall being spaced from and extending around one side of the second cylinder.

Figure 8:
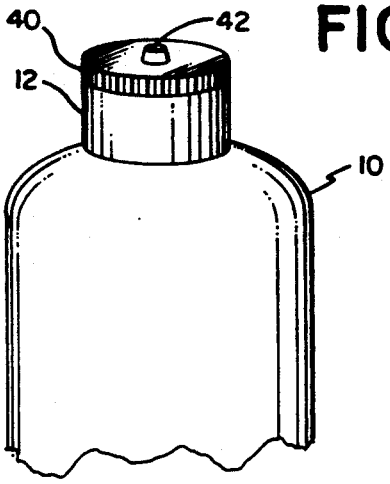
FIG. 8 shows the embodiment of FIG. 1 secured to a container.

A horizontally elongated member which in the horizontal plane has the shape of a figure 8 with left hand half section 24 and right hand section 26 has a top flat end having a surface with first and second spaced holes therein. Each hole has the same shape and size as the first opening and is disposed in a corresponding one of the half sections, one of said holes 28 being sealed with a flexible slightly upwardly rounded cover 30, the other hole 32 being open. The two half sections are interconnected in common by two oppositely disposed inwardly extending generally V shaped peripheral regions 48. The member has an open bottom end which is peripherally surrounded by a downwardly extending peripheral second lip 34. The member rests slidably on top of the second cylinder, one side of said member slidably engaging said wall.

The member is flexible and is provided with first and second slots 36 and 38. Each slot is adjacent the periphery of a corresponding one of the sides of the member, each slot extending from one half section to the other and conforming in shape to the corresponding adjacent portion of the periphery.

A third vertical hollow cylinder 40 has a flat top surface with a second central opening 42 aligned with the bore of the second cylinder. The third cylinder rotatably engages the first lip 18 and the surface of the member. The third cylinder has first and second spaced vertical prongs 44 and 46 extending downwardly from its top surface.

Figure 5:
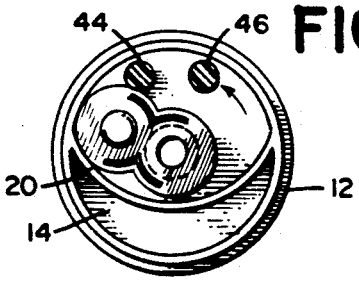
FIGS. 5, 6 and 7 are views illustrating the opening and closing action of the embodiment of FIG. 1.
Figure 4:
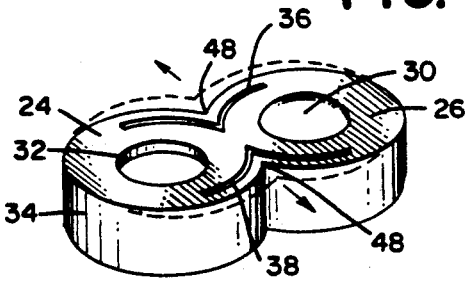
FIG. 4 is a perspective view of a V shaped member used in the invention.
Figure 6:
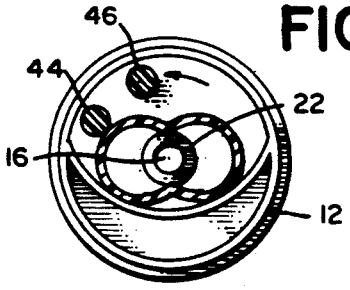
Figure 7:
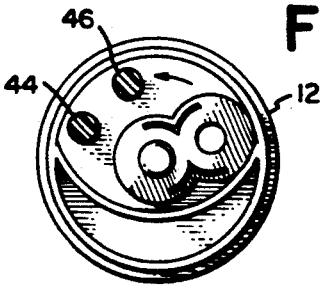

When the third cylinder is rotated in one direction [counterclockwise as shown in FIGS. 5, 6 and 7] with respect to the first cylinder, the first prong engages the member and causes it to move into a first position at which the open hole engages the top end of the second cylinder and opens the bore, thereby allowing material to be removed or discharged from the container. More particularly, when the first prong engages the member, it penetrate the adjacent region 48. Since the diameter of the prong is larger than the region, the region is deformed and is forced to expand. This expansion causes the slot adjacent to the expanded region to be correspondingly deformed. Continued movement of the prong allows the deformed region to reform and the slot is also reformed in the manner of a spring. This produces a snap action forcing the member into the desired second position. When the third cylinder is rotated in the opposite direction, the reverse snap action is produced and the member is forced into the desired first position.

The cover 30 fits tightly into opening 42 and cannot be accidentally moved out of alignment with the opening 42, thereby forming a tight closed seal.

While the invention has been described with specific reference to the preferred embodiment, the protection sought is to be limited only by the terms of the claims which follow.

What is claimed is:

1. A cap adapted to be secured to an open end of a container, said cap comprising:

a first vertical hollow cylinder having an open lower end adapted to be secured to the open end of the container, the first cylinder having a closed upper end with a small centrally disposed first opening therein and has a raised peripheral first lip;

a curved vertical wall secured to and extending upwardly from the upper end of the first cylinder, the wall engaging the first lip at two spaced apart positions, said positions and the first opening being disposed essentially along a common horizontal line, the wall being spaced from the first opening and curving around one side of the first opening, the top of the wall being horizontally aligned with the top of the first lip;

a second vertical hollow cylinder open at both ends and secured to the upper end of the first cylinder with an upper end horizontally aligned with the top of the wall, the second cylinder having an axial bore vertically aligned with the first opening, the wall being spaced from and extending around one side of the second cylinder;

a horizontally elongated member which in the horizontal plane has the shape of a figure 8 with left hand and right hand half sections, the member having a top flat surface with first and second spaced holes therein, each hole having the same shape and size as the first opening and being disposed in a corresponding one of the half sections, one of said holes being sealed, the other hole being open, the member having an open bottom end which is circumferentially surrounded by a downwardly extending peripheral second lip, the member resting slidably on top of the second cylinder, one side of said member slidably engaging said wall; and a third vertical hollow cylinder having a flat top surface with a second central opening aligned with the bore of the second cylinder and having an open bottom end, the third cylinder rotatably engaging the first lip and the surface of the member, the third cylinder having first and second spaced vertical prongs extending downwardly from its top surface, the third cylinder when rotated in one direction with respect to the first cylinder causing the first prong to engage the member, the member moving into a first position at which the sealed hole seals off the top end of the second cylinder, the third cylinder when rotated in the opposite direction causing the second prong to engage the member, the member moving into a second position at which the open hole is aligned with the open bore.

2. The cap of claim 1 wherein the member is flexible.

3. The cap of claim 2 wherein the half sections share two oppositely disposed inwardly extending V shaped regions and the member has two elongated slots, each slot being disposed adjacent the periphery of a corresponding one of the sides of the member, each slot extending from one half section to the other and conforming in shape to the corresponding V shaped regions.

4. The cap of claim 3 wherein engagement of a V shaped region by member by a prong first causes the adjacent slot to be deformed, the slot then returning to its undeformed state, producing a snap action forcing the member into the desired position.

5. A cap comprising:

a flat circular disc with a small centrally disposed first opening therein and having a raised peripheral first lip;

a curved vertical wall secured to and extending upwardly from the disc, the wall engaging the first lip at two spaced apart positions, said positions and the first opening being disposed essentially along a common horizontal line, said wall being spaced from the first opening and curving around one side of the first opening, the top of the wall being horizontally aligned with the top of the first lip;

a first vertical hollow cylinder open at both upper and lower ends and secured at its lower end to said first opening, the upper end of the first cylinder being horizontally aligned with the top of the wall, the first cylinder having an axial bore vertically aligned with the first opening, the wall being spaced from and extending around one side of the first cylinder;

a horizontally elongated member which in the horizontal plane has the shape of a figure 8 with left hand and right hand half sections, the member having a top flat surface with first and second spaced holes therein, each hole having the same shape and size as the first opening and being disposed in a corresponding one of the half sections, one of said holes being sealed, the other hole being open, the member having an open bottom end which is circumferentially surrounded by a downwardly extending peripheral second lip, the member resting slidably on top of the first cylinder, one side of said member slidably engaging said wall; and a second vertical hollow cylinder having a flat top surface with a second central opening aligned with the bore of the second cylinder and having an open bottom end, the second cylinder rotatably engaging the first lip and the surface of the member, the third cylinder having first and second spaced vertical prongs extending downwardly from its top surface, the second cylinder when rotated in one direction with respect to said first cylinder causing said first prong to engage the the member and move it into a first position at which the sealed hole seals off the bore, the second cylinder when rotated in the opposite direction causing the second prong to engage the member and move it into a second position at which the open hole is aligned with the open bore.

* * * * *